United States Patent [19]

Branson

[11] 4,003,360

[45] Jan. 18, 1977

[54] ELECTRIC IGNITION SYSTEM

[75] Inventor: Charles D. Branson, Greensburg, Pa.

[73] Assignee: Robertshaw Controls Company, Richmond, Va.

[22] Filed: Nov. 20, 1975

[21] Appl. No.: 633,732

[52] U.S. Cl. ..... 126/39 E; 431/256

[51] Int. Cl.[2] ..... F23Q 7/12

[58] Field of Search ..... 126/39 R, 39 E, 39 BA; 431/256, 266, 255

[56] References Cited

UNITED STATES PATENTS

| | | | |
|---|---|---|---|
| 2,300,156 | 10/1942 | Higley | 126/39 E |
| 3,405,869 | 10/1968 | Graysih et al. | 431/256 X |
| 3,477,797 | 11/1969 | Zielinski et al. | 431/256 |

*Primary Examiner*—Edward G. Favors
*Attorney, Agent, or Firm*—Harold W. Adams

[57] ABSTRACT

An electric ignition system for a gas cooking range that includes a low voltage circuit for energizing one or a plurality of parallel connected electric resistance igniters in response to the operation of a control valve supplying gas to a burner. Each resistance igniter element is connected to the secondary winding of a stepdown voltage transformer in an electrical circuit one side of which is the electrically conductive range body or housing and the second an insulated conductor assembled in the range at the time of its manufacture.

The conductor may be coated with porcelain, an insulation material capable of withstanding the high temperature environment within the range without deterioration and breakdown. Both ends of this electrical circuit are easily accessible permitting ready replacement of the resistance igniter element and transformer. The primary side of the circuit is connected to a suitable supply voltage through a normally open switch operated by the gas supply control valve for the burner. Signal means may also be provided to indicate when the igniters are energized.

9 Claims, 6 Drawing Figures

ELECTRIC IGNITION SYSTEM

BACKGROUND OF THE INVENTION

This invention relates to an electric ignition system for the burners of a gas range, either top, oven, or broil, employing resistance igniter elements.

DESCRIPTION OF PRIOR ART

Conventional gas ranges having a plurality of top burners and electric resistance igniters for lighting the gas instead of conventional standing pilots are known. For instance see U.S. Pat. No. 2,705,531 and 3,799,730 as representative of such prior art devices as well as copending U.S. Pat. application, Ser. No. 469,720, filed May 14, 1974, Pat. No. 3,938,944 and assigned to the same Assignee as this application.

A disadvantage of conventional low voltage resistance ignition systems is the excessive and expensive use of heavily insulated copper wire or nickleplated, stainless steel conductors required to withstand the high temperatures in the range.

SUMMARY OF THE INVENTION

The invention is summarized in that the wiring of low voltage electric resistance igniter elements for the burners of a gas range is effected using the electrically conductive housing of the range as one side or conductor of the electrical circuit, the second side of the circuit is a porcelain coated, and thus insulated and high heat resistant conductor assembled within the range at the time of manufacture. The second conductor may be mounted within the insulated side walls of the range housing for further heat protection or affixed directly to the metal range housing. Connections to one or more electrical resistance igniters in this novel circuit as well as to the secondary winding of an externally mounted stepdown voltage transformer are easily accessible for repair, replacement and trouble shooting of the ignition system.

The primary of the stepdown or line voltage isolation transformer is connected to a suitable alternating current power supply through a normally open switch closed by one or more gas control valves that supply gas to a selected burner when the respective valve associated with that burner is turned on. This simultaneously energizes all igniter elements which condition is indicated by a signal lamp connected to the primary side of the transformer.

BRIEF DESCRIPTION OF DRAWINGS

FIG. 6 is an electrical illustrating the electrical power supply and means for energizing the resistance igniters when the gas supply control valves for the burners are turned on.

DESCRIPTION OF A PREFERRED EMBODIMENT

Figure 1:
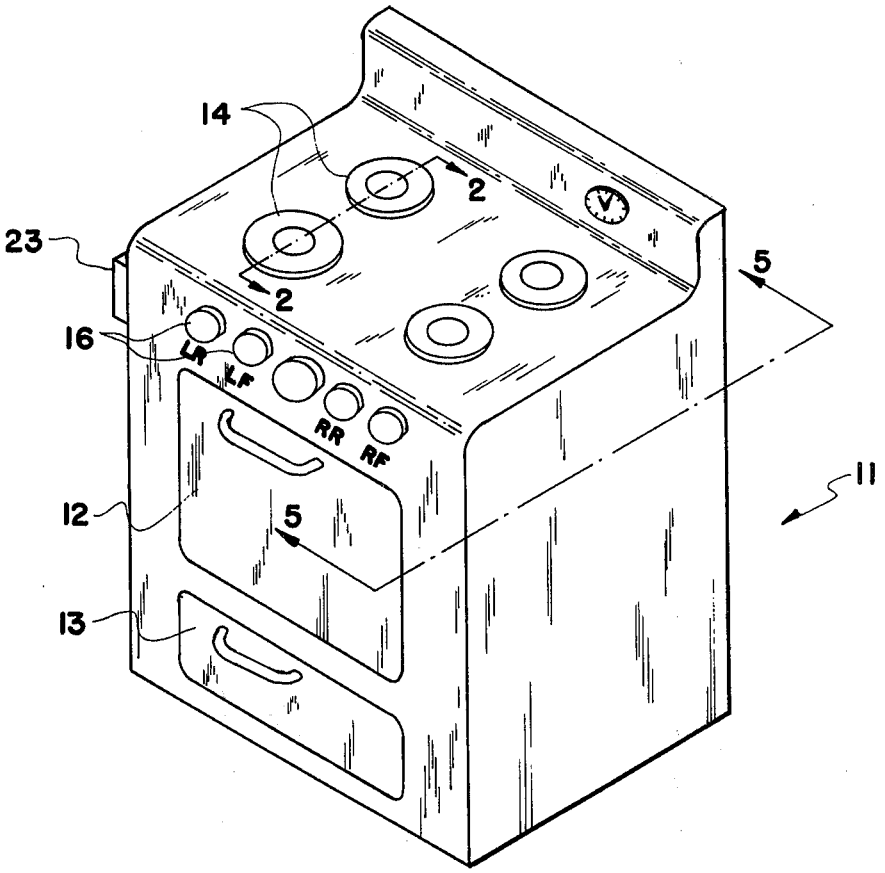
FIG. 1 is a perspective view of a multiple top burner gas range with an oven including an electric ignition system in accordance with the invention.

Referring to FIG. 1 a conventional gas range 11 incorporating the invention is illustrated as including an oven 12, a broiler 13, and a plurality of top burners 14 each of which are supplied gas through a conventional control valve provided with a knob 16 mounted on the front of the range. Each knob 16 is designated so as to identify the respective top, oven, and/or broiler burners as is well known.

Figure 2:
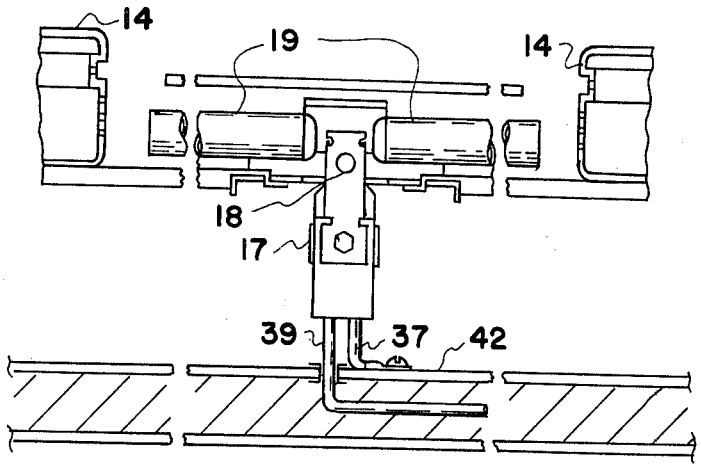
FIG. 2 is a partial cross-sectional view taken along lines 2 — 2 in FIG. 1 illustrating an igniter assembly for a pair of top burners.
Figure 3:
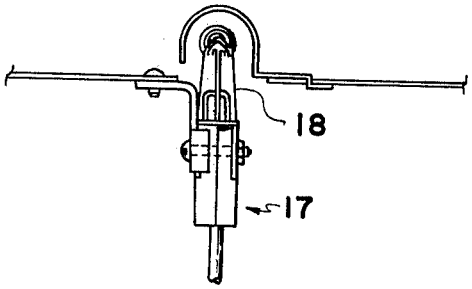
FIG. 3 is a perspective view of a resistance igniter sub-assembly of the igniter assembly of FIG. 2.
Figure 4:
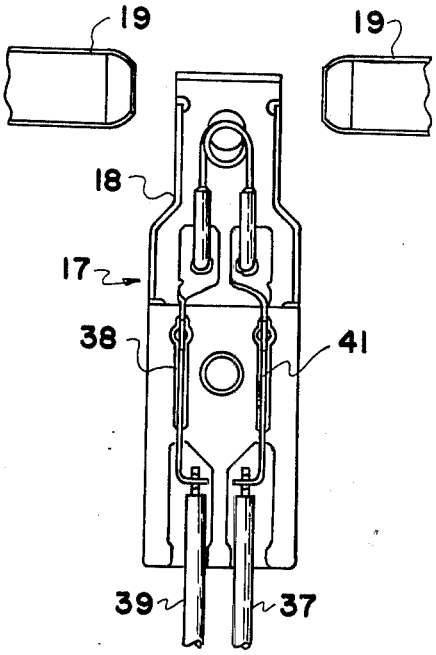
FIG. 4 is a cross-sectional view of the igniter sub-assembly of FIG. 3.

As shown in FIG. 2 a low voltage, electric resistance igniter assembly 17 that includes an igniter element 18 may be spaced between each pair of top burners 14 marked left and right respectively. Similarly, a single resistance igniter assembly 17 (not shown) may be positioned between the oven and broiler burners. The igniter elements are connected in parallel circuit relationship.

Flash tubes 19 lead a gaseous fuel mixture from a supply not shown to the igniter assembly 17 when one or both of the knobs 16 associated with the control valves supplying gas to the burners 14 are turned on. This simultaneously energizes the electric resistance igniter element 18 effecting ignition as readily understood by those skilled and knowledgeable in the art.

For a further detailed description of construction and operation of resistance igniter elements refer to copending U.S. Pat. application Ser. No. 469,720, filed May 14, 1974, incorporated herein by reference for the purpose of disclosure.

Figure 6:
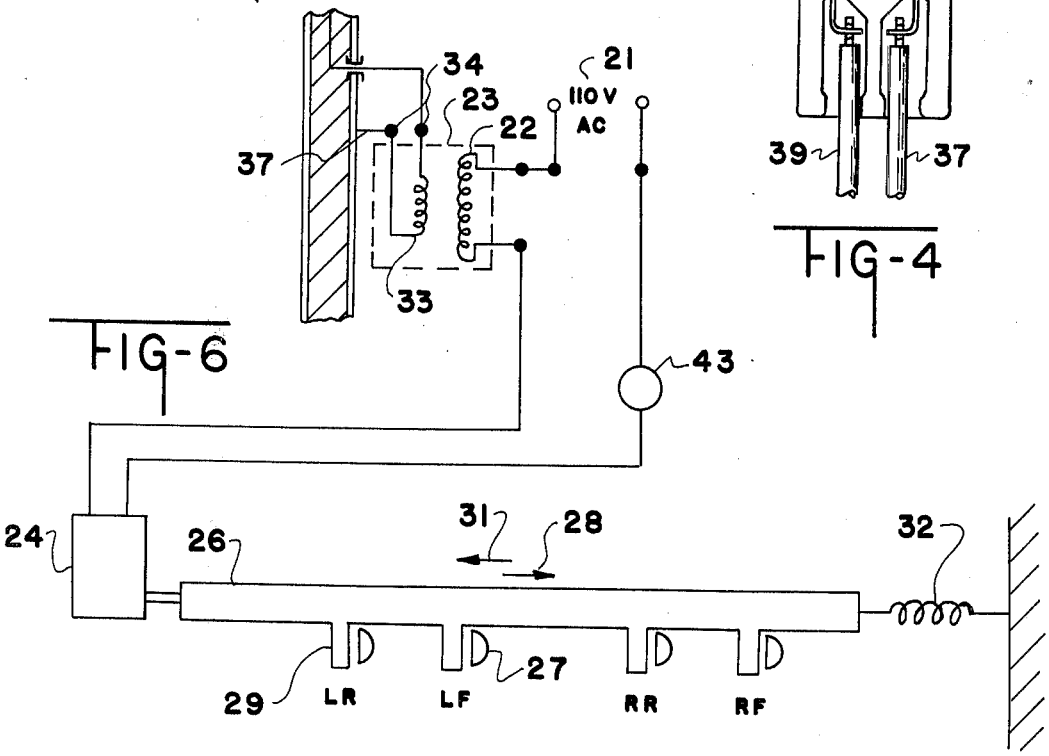

As shown in FIG. 6 a suitable alternating current voltage 21 from a supply not shown is connected to the primary winding 22 of a stepdown transformer 23 mounted on the outside of the range housing (FIG. 1) through a normally open switch 24. The switch 24 is closed by means of a toothed bar 26 mounted in and near the front of the range 11 adjacent cam shaped valve stems or shafts 27 upon which the knobs 16 are affixed.

The bar 26 is normally urged in the direction of arrow 28 and the switch 24 remains open since the flat side of each valve stem 27 remains substantially parallel to the respective adjacent tooth 29 with which associated. As a control knob 16 is turned on it rotates the valve stem upon which mounted to urge the curved position of the cam shaped stem against the adjacent tooth 29 moving the bar 26 in the direction of arrow 31 closing switch 24 simultaneously with the opening of the control valve to supply a gaseous fuel mixture to the selected burner.

As can be seen the switch 24 remains closed as long as any one of the burner gas control valve knobs 16 is turned "on". When all are "off" spring 32 moves the bar 26 in the direction of arrow 28 permitting the switch 24 to open.

Figure 5:
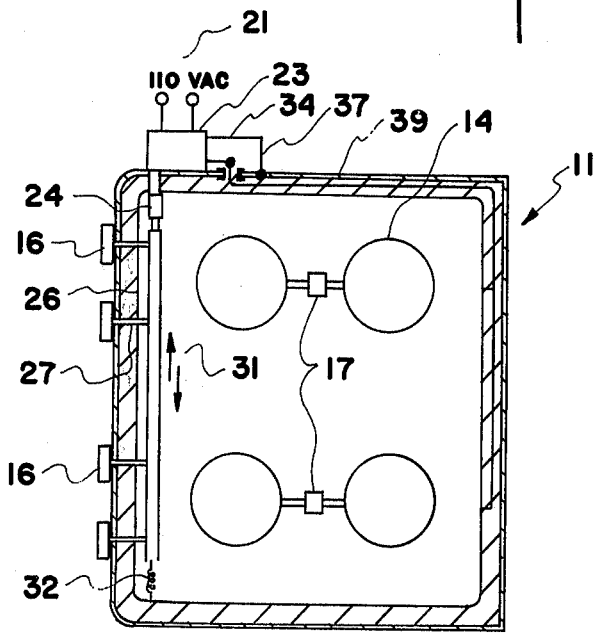
FIG. 5 is a cross-sectional view taken along lines 5 — 5 of FIG. 1 illustrating the wiring of an electrical ignition system for a pair of top burners of a gas range in accordance with the invention.

The secondary winding 33 of transformer 23 is brought out on external terminals 34 one of which is electrically connected to the metal sidewall of the range 11 by means of a conductive strap 37. The other terminal 34 is electrically connected to a post 38 of an igniter element 18 by means of an electrically insulated conductor 39 of which a portion as shown in FIGS. 2 and 5 may pass through the conventional heat insulating material generally used to fill the hollow side walls of the range surrounding the oven and broiler cavities.

The electrical circuit is completed by means of a second conductive strap 37 connected between post 41 of igniter element 18 and any convenient point on an interior metal wall 42 that is electrically connected to the range sidewall or housing.

Thus the range housing itself completes one side of the circuit while the second side or conductor 39 is preferably a porcelain coated, flat mild steel strip assembled within the range at the time of manufacture. The procelain serves as an excellent high temperature resistant electrical insulator that easily withstands temperatures above which conventional insulated copper conductors can deteriorate and breakdown. Also, while insulated nickle coated, stainless steel conductors capable of withstanding temperatures well in excess of 450° over a long period of time are available, they are considerably more expensive than the single porcelain coated stainless steel strip mild steel strip.

Another economic advantage of the invention over the use of conventional wiring is that the mild steel strip can be porcelain coated by the range maker at the time of porcelain enamaling the range. This permits the connections to the igniter elements and the isolation transformer to be conveniently located at accessible points for ease of repair, maintenance and replacement of the ignition system components.

As can be seen, since all resistance igniter elements 18 are parallel connected to the secondary winding 33, all igniter elements are energized and remain so when any one of the gas control knobs 16 is turned on to close switch 24 and supply gas to a selected burner 14. This on condition is indicated by a signal lamp 43 connected in the primary side of the circuit. Maintaining all igniters energized when but one burner is on assures ignition in the event of leakage at one of the other valves or an unexpected flame out at burner supposed to on such as might occur as a result of a draft, or loss of gas pressure at a low burner flame valves setting.

While a preferred embodiment of the invention has been described as including four top burners and the igniters, one for each pair of adjacent burners, the number of either can be varied in the practice of the invention which is to be limited only by the scope of the appended claims.

What is claimed is:

1. In an electric ignition system for a gas cooking range having electrically conductive side and interior walls and including at least one burner, a gas control valve for regulating the flow of gaseous fuel to said burner, and an electric resistance igniter positioned to ignite said gaseous fuel at said burner when energized, the improvement comprising;

circuit means operated by said valve means for simultaneously energizing said igniter when said control valve is turned on, said circuit means providing two electrically conductive paths connected to said igniter, a portion of one of said electrically conductive paths including the walls of said range.

2. An electric ignition system for a gas cooking range as defined in claim 1 wherein said second of said conductive paths includes an insulated conductor connected to said igniter.

3. An electric ignition system as defined in claim 2 wherein said insulated conductor comprises a metallic strand coated with an insulative, heat resistant material.

4. An electric ignition system as defined in claim 1 wherein said circuit means comprises:

an alternating current voltage supply;

a stepdown transformer having a primary winding inductively coupled thereto and a secondary winding connected to said igniter by said two conductive paths;

a normally open switch interconnecting said primary winding to said voltage supply; and mechanical means operated by said control valve for closing said normally open switch upon the opening of said valve thereby simultaneously supplying gas to said burner and energizing said igniter.

5. An ignition system as defined in claim 4 wherein said control valve includes a rotatable cam shaped stem and said mechanical means comprises cam follower means for engaging said cam shaped stem and closing said switch upon rotation of said valve stem to an on position opening said valve.

6. An ignition system as defined in claim 5 including spring means for moving said cam follower means to restore said normally open switch to its open position when said valve stem and thus said control valve is turned to an off position.

7. An electric ignition system as defined in claim 1 wherein the gas cooking range includes an even number of burners and an individual gas control valve therefore, there being provided one of said resistance igniters for each adjacent pair of said burners, all of said igniters being connected in parallel by said circuit means.

8. An electric ignition system as defined in claim 7 wherein each of said control valves includes a rotatable cam shaped valve stem having a knob affixed thereto and including a movable bar having a plurality of cam follower surface members thereon for closing said normally open switch, there being one of said cam follower surface members positioned adjacent to each one of said cam shaped valve stems whereby said normally open switch is closed when any one of said valve stems is rotated from an off to an on position.

9. An electric ignition system as defined in claim 8 including spring means for disengaging said bar from said normally open switch when all of said valve stems are in the off position.

* * * * *